US006502512B2

(12) United States Patent
Riviere et al.

(10) Patent No.: US 6,502,512 B2
(45) Date of Patent: Jan. 7, 2003

(54) SECURED HIGH-POWER ELECTRO-PYROTECHNIC INITIATOR

(75) Inventors: Christophe Riviere, Orleans (FR); Eric Poulard, Lamotte (FR)

(73) Assignee: TDA Armements SAS, La Ferte-Saint-Aubin (FR)

( * ) Notice: Subject to any disclaimer, the term of this patent is extended or adjusted under 35 U.S.C. 154(b) by 0 days.

(21) Appl. No.: 09/902,776

(22) Filed: Jul. 12, 2001

(65) Prior Publication Data

US 2002/0023567 A1 Feb. 28, 2002

(30) Foreign Application Priority Data

Jul. 13, 2000 (FR) ..... 00 09243

(51) Int. Cl.[7] ..... F42B 3/10

(52) U.S. Cl. ..... 102/202.7; 102/202.1; 102/202.9; 102/202.14

(58) Field of Search ..... 102/202.1, 202.2, 102/202.3, 202.4, 202.7, 202.9, 202.14, 202.5

(56) References Cited

U.S. PATENT DOCUMENTS

| | | | | |
|---|---|---|---|---|
| 3,002,458 A | * | 10/1961 | Haas | 102/202.1 |
| 3,117,519 A | * | 1/1964 | Hamilton et al. | 102/202.1 |
| 3,262,389 A | * | 7/1966 | Bryla et al. | 102/202.9 |
| 3,797,393 A | * | 3/1974 | Marchandise et al. | 102/202.7 |
| 4,441,427 A | | 4/1984 | Barret | 102/202.2 |
| 4,944,225 A | * | 7/1990 | Barker | 102/202.7 |
| 5,204,491 A | | 4/1993 | Auréal et al. | 102/202.14 |
| 5,347,929 A | | 9/1994 | Lerche et al. | 102/202.14 |
| 5,431,104 A | | 7/1995 | Barker | 102/202.7 |
| 5,969,286 A | | 10/1999 | Ward et al. | 102/202.7 |

FOREIGN PATENT DOCUMENTS

| | | |
|---|---|---|
| EP | 0 482 969 | 4/1992 |

* cited by examiner

*Primary Examiner*—Harold J. Tudor
(74) *Attorney, Agent, or Firm*—Oblon, Spivak, McClelland, Maier & Neustadt, P.C.

(57) ABSTRACT

The slapper type initiator comprises essentially: a connector unit (2) having two connection pins (3, 4), a first dielectric foil (5) with two drilled holes (6, 7), with a fuse (8) formed on the rear face of this first dielectric foil, a second dielectric foil (9) on the front face of which there are formed two metal pads (10, 11) facing said holes, a perforated plate (12) and a body (13) containing a pyrotechnic charge 14. The assembly is hermetically sealed. The first foil introduces a galvanic discontinuity that ensures a well-defined firing voltage, with a value high enough to prevent induced parasitic currents.

8 Claims, 2 Drawing Sheets

SECURED HIGH-POWER ELECTRO-PYROTECHNIC INITIATOR

BACKGROUND OF THE INVENTION

The invention relates to a secured high-power electro-pyrotechnic initiator.

The high-power electro-pyrotechnic initiator works according to the well-known principle of the "slapper" or "exploding foil initiator" (EFI). In its most standard version, known as a "finite perforated-plate slapper", it comprises an electrical circuit such as a current pulse equal to some thousands of amperes generated within a few tens of nanoseconds prompting the volatilization of a part of the conductor (fuse bridge) and the formation of a metal plasma. The very sudden expansion of the confined metal plasma is used to impel a projectile against the face of a pyrotechnic filling (a secondary explosive or a low-sensitive pyrotechnic composition). This projectile consists of a plastic disk, some tens of micrometers thick, with a diameter of about one millimeter. This disk is produced by cutting through a bored element (a perforated plate) made of plastic film. The initiation of the pyrotechnic charge (the detonation of the secondary explosive or explosion of the pyrotechnic composition) is prompted by the impact of the projectile driven by an impact speed of several kilometers per second.

In another version of the high-power electro-pyrotechnic initiator, known as a "bubble slapper", the plastic film is not cut out through the perforated plate but forms a bubble whose diameter is limited by the perforated plate. It is the impact at the peak of the bubble that initiates the pyrotechnic charge.

An EFI type high-power electro-pyrotechnic initiator is commonly formed by a connection device with two contact zones or two pins electrically connected by the fuse circuit. The fuse circuit and the plastic film to be impelled are confined between the perforated plate and an anvil. The compressed pyrotechnic charge is placed in a box facing the perforated plate. The assembly thus formed may be hermetically sealed (French patent 2 669 725).

Parasitic electrical currents may be induced in the electronic control circuits connected upline from the initiator. These parasitic currents may be caused by the fact that these circuits are generally unsheathed or are poorly sheathed. Owing to the low electrical resistance of the fuse circuit (equal to some tens of milliohms), said parasitic electrical current coming through the connection zones may cause deterioration in the fuse bridge or make it melt and thus affect the reliability of the initiator.

SUMMARY OF THE INVENTION

An object of the invention is a slapper type electro-pyrotechnic initiator whose reliability is not affected by parasitic currents induced in the circuits to which it is connected, the initiator having low-cost components that are simple to manufacture and assemble, with triggering characteristics that are precise and independent of the surrounding conditions (such as atmospheric pressure, temperature, air moisture content, etc.).

The slapper type initiator according to the invention, with connection device having control circuits, fuse circuit, perforated plate and pyrotechnic charge, comprises a calibrated electrical discontinuity device between the connection device and the fuse circuit.

BRIEF DESCRIPTION OF THE FIGURES

The present invention will be understood more clearly from a detailed description of an embodiment given by way of a non-restrictive example and illustrated by the appended figures, of which.

MORE DETAILED DESCRIPTION

The initiator described here above is of the type with a two-pin connector unit and a fuse positioned in a plane transversal to its axis, but it is clear that the invention relates to other types of connections and to fuses arranged differently, The electro-pyrotechnic initiator of the invention may also be of the detonator type with an explosive charge as well as an igniter type with an explosive charge comprising a pyrotechnic composition. It may be used to initiate the operation of a military payload, a missile thruster or rocket thruster or a gas generator.

Figure 2:
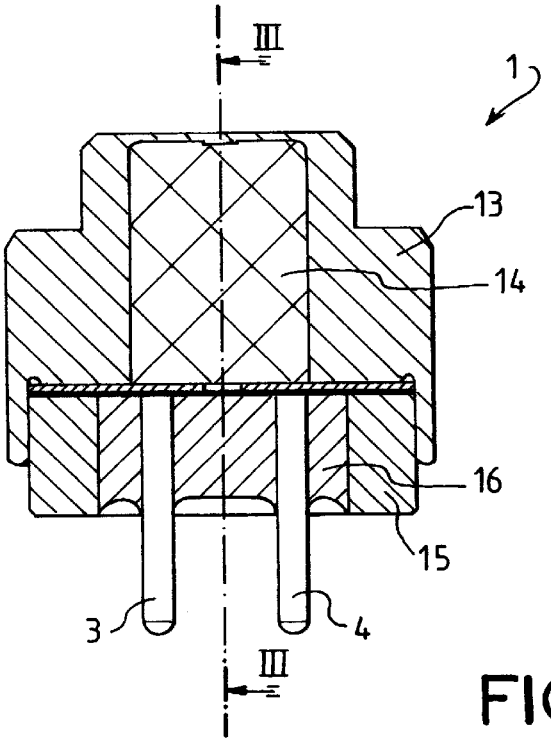
FIGS. 2 and 3 are longitudinal sectional views of the initiator of FIG. 1, along mutually orthogonal sectional planes, both passing through the axis of the initiator.
Figure 3:
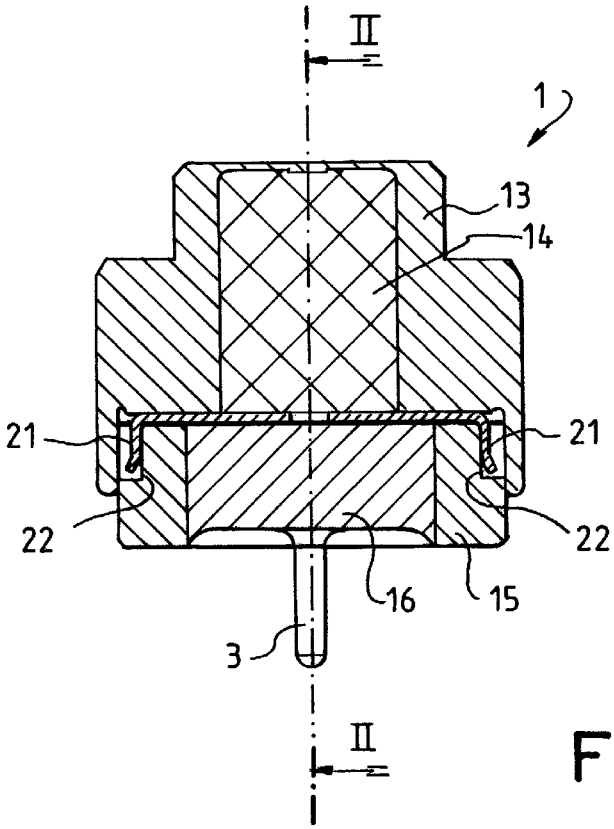

The embodiment of the initiator 1 shown in FIGS. 1 to 3 essentially comprises the following elements in the following order: a connector unit 2 having two connection pins 3, 4 mutually insulated and arriving flush with the rear face of the connector unit (see FIG. 2), a first foil of dielectric material 5 in which two holes 6 and 7 are drilled, these holes facing the rear ends of the pins 3, 4 when this foil is applied to the rear face of the connector unit, the diameter of these holes being substantially equal to that of the pins 3, 4, a metal fuse circuit 8 being fixed to or formed on the rear face of the foil 5, a second foil 9 made of a dielectric material on the rear face (the face that is before the foil 5) on which two metal pads 10, 11 are attached or formed, a "perforated plate" 12 and a body 13 of the initiator comprising, on its front face, a coaxial pyrotechnic charge 14. The body 13 takes the form of a cylindrical bowl whose internal diameter is practically equal to the external diameter of the connector unit 2. The elements 2 and 18 to 14 have been made in a manner known per se and shall be described only briefly.

The connector unit 2 essentially comprises a ring-like body 15 in which a central disk 16 is hermetically sealed. This disk 16 is made of glass. Pins 3, 4 pass hermetically through this disk. The rear face of the disk 16 is flat and the rear ends of the pins 3, 4 arrive in a position where they are flush with this face as specified here above.

The foil 5, which is one of the important, novel elements of the invention, has a well-determined thickness that depends on the voltage of triggering of the initiator as described here below. According to an exemplary embodiment, this film has a thickness of some tens of micrometers, for example about 50 $\mu$m. The holes 6, 7 made in the foil 5 are facing the rear ends of the pins 3, 4 when the foil 5 is mounted in position in the initiator and applied firmly to the rear face of the disk 16. The fuse circuit 8 has, for example, an oblong shape comprising a constriction 17 in the middle of its length and apertures 18, 19 made at its ends corresponding to the holes 6, 7. The diameter of the apertures 18, 19 are substantially equal to those of the holes 6, 7. The pads 10, 11 are coaxial to the holes 6, 7 respectively (when the initiator is mounted) and their diameter is greater than that of the holes. Advantageously, the diameter of the pads 10, 11 is equal to or slightly greater than the width of the oblong shape (measured perpendicularly to the line joining the centers of the apertures 18, 19) of the fuse circuit 8.

To ensure the accurate mounting of the foils 5 and 9 with respect to the connector unit 2 and the perforated plate 12, on the periphery of each of these foils, for example, two diametrically opposite notches 20 are made. Two clip-on tongues 21, with a shape corresponding to that of the notches 20, fit into these notches 20 during assembly. During assembly, these clip-on tongues 21 fit into flat portions 22 made on the periphery of the connector 2 so as to align the pins 3, 4 with the holes 6, 7 of the foil 5 and the pads 10, 11 of the foil 9.

In the exemplary embodiment, the foil 5 is made of flexible dielectric material, polyimide for example, with a thickness of some tens of $\mu$m, for example 50$\mu$. The fuse circuit 8 is a metal layer with a thickness of some $\mu$m. It is made for example of copper with a thickness of 5 $\mu$m. The foil 9 is made with the same material as that of the foil 5 and has a thickness of the same range of magnitude as that of the foil 5, for example 25 $\mu$m. The is two pads 10, 11 are each formed, for example, by a metal layer with a thickness of some $\mu$m, for example copper with a thickness of 5 $\mu$m. The perforated plate 12 is an element made of insulating or conductive material with a thickness of 0.2 mm and it is drilled with a central hole 12A having a diameter of about 1 mm. The pyrotechnic charge 14 is constituted by a secondary explosive or any pyrotechnic composition. It is placed in the body 13 or compressed on site.

Figure 1:
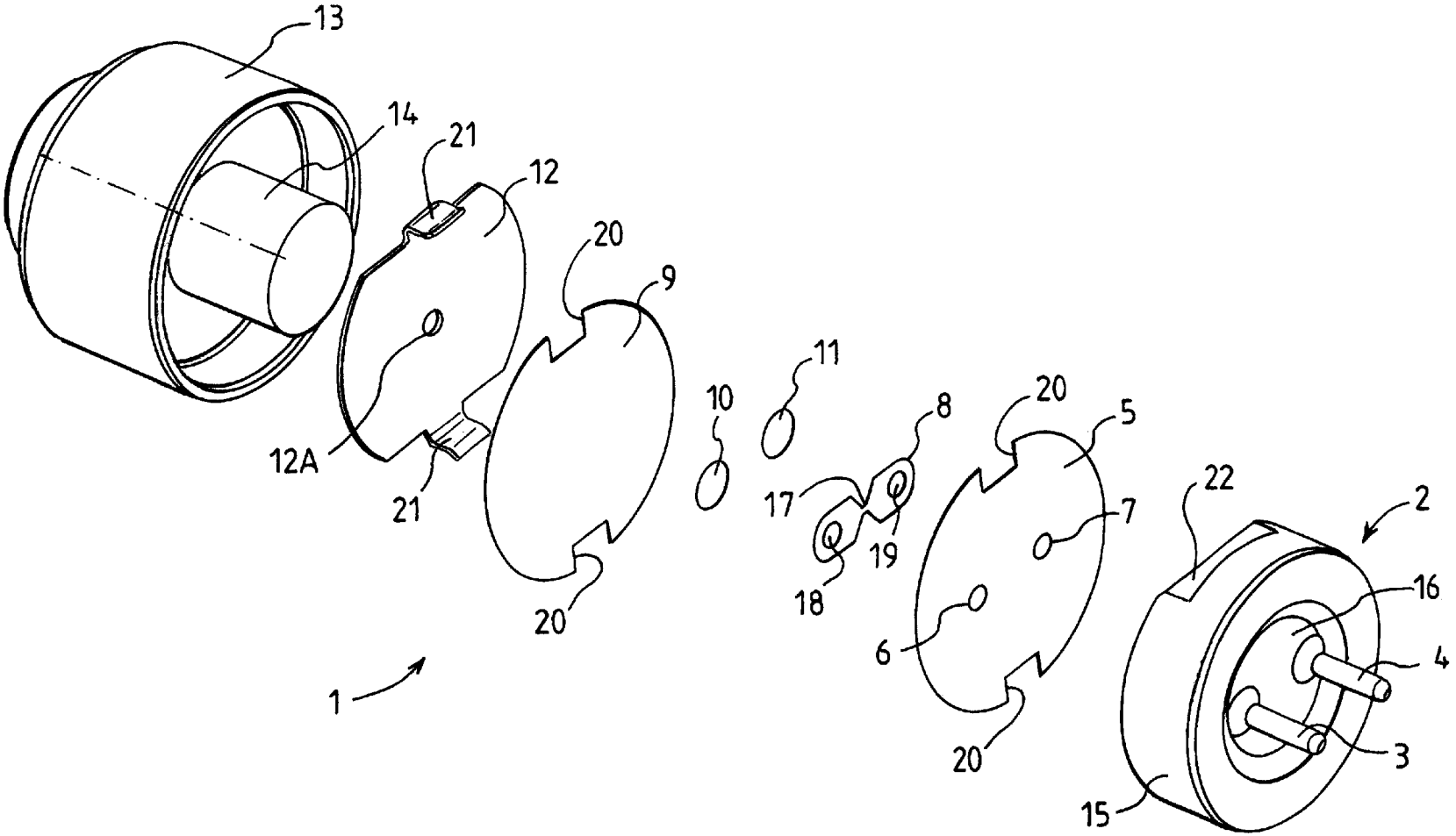
FIG. 1 is an exploded view of a first embodiment of an initiator according to the invention.

The assembling of the elements shown in FIG. 1 consists in positioning the foils 5 and 9 between the perforated plate 12 and the connector unit 2 by aligning their notches 20 with the corresponding flat portions 22, the pads 10, 11 being applied to the fuse circuit 8, and then by firmly applying the perforated plate to the connector unit. thus clipping the tongues 21 of the perforated plate on to the flat portion 22. The assembly thus constituted is prestress-mounted into the body 13 in which the charge 14 has been mounted beforehand. The body 13 is then hermetically soldered to the connector unit 2, for example by laser soldering, Then, the device shown in FIGS. 2 and 3 is obtained.

The device described here above works as follows: the electrical firing pulse, produced in a manner known per se by the circuits connected upline with respect to the initiator, reaches the connection pins 3, 4. An electrical arc is formed immediately between the rear plane faces of the pins 3, 4 and the metallized pads 10, 11. Since these pads are in galvanic contact with the fuse circuit 8, the firing current circulates in the constriction 17 of this fuse circuit, sublimating it. The metal plasma thus formed propels the central part of the foil 9 through the hole 12A of the perforated plate 12 at very high speed (3000 to 4000 m/s). The impact of this part of the foil 9 on the pyrotechnic charge 14 prompts its initiation.

Since the initiator is hermetically closed during assembly, it is easy to check the quality of the atmosphere that it contains (dry air with a well-determined pressure and composition). Furthermore, since the distance between the pads 10, 11 and the rear end of the pins 3, 4 is perfectly defined by the thickness of the foil 5, the electrical arc produced inside the initiator appears for a well-defined voltage sent to the pins 3, 4 and these conditions are reproducible for all the initiators. Owing to the small thickness of the foil 5 (some tens of $\mu$m in general), the energy absorbed by the discontinuity of the firing circuit (no electrical contact between the pins 3, 4 and the fuse circuit 8) is low and the working of the initiator remains very reliable.

The other advantages of the initiator of the invention are: rigid and sturdy construction (high mechanical resistance of the body 13 and the connector 2), hermetic sealing of the chamber formed by the body and the connector unit, giving the initiator longevity and stable triggering characteristics in time, irrespectively of the environment (moisture and altitude), simplicity of manufacture and assembly of the different components and simplicity of implementation.

What is claimed is:

1. An electro-pyrotechnic initiator comprising:

a connector unit;

two connection pins passing through said connector unit;

a first dielectric foil having one side applied to a face of the connector unit such that ends of said pins face holes through said first dielectric foil;

a fuse circuit provided at another side of said first dielectric foil at said holes, such that said fuse circuit is separated from said ends of said pins by the thickness of the first dielectric foil to form a calibrated electrical discontinuity, wherein there is no electrical contact between said pins and said fuse circuit;

a second dielectric foil applied to a side of said fuse circuit opposite said first dielectric foil and including a portion providing a slapper;

a perforated plate applied to a side of said second dielectric foil opposite said fuse circuit, said perforated plate being connected to said connector unit so as to grip the first and second dielectric foils between said perforated plate and said connector unit; and a pyrotechnic charge positioned so as to be initiated by said slapper.

2. An initiator according to claim 1, wherein the ends of the pins are flush with the face of the connector unit to which the first dielectric foil is applied.

3. An initiator according to claim 2 or 1, including conductive pads facing the holes of the first foil and applied against the fuse circuit, and provided at the second foil.

4. An initiator according to claim 2 or 1, wherein the first and second dielectric foils each have a thickness of some tens of $\mu$m.

5. An electro-pyrotechnic initiator comprising:

a connector unit;

a connection pin passing through said connector unit;

a first dielectric foil having one side applied to a face of the connector unit such that the end of said pin faces a hole through said first dielectric foil;

a fuse circuit provided at another side of said first dielectric foil at said hole, such that said fuse circuit is separated from said end of said pin by the thickness of the first dielectric foil to form a calibrated electrical discontinuity, wherein there is no electrical contact between said pin and said fuse circuit;

a second dielectric foil applied to a side of said fuse circuit opposite said first dielectric foil and including a portion providing a slapper;

a perforated plate applied to a side of said second dielectric foil opposite said fuse circuit, said perforated plate being connected to said connector unit so as to grip the first and second dielectric foils between said perforated plate and said connector unit; and a pyrotechnic charge positioned so as to be initiated by said slapper.

6. An initiator according to claim 5, wherein the end of the pin is flush with the face of the connector unit to which the first dielectric foil is applied.

7. An initiator according to claim 5 or 6, including a conductive pad facing the hole of the first foil and applied against the fuse circuit, and provided at the second foil.

8. An initiator according to claim 5 or 6, wherein the first and second dielectric foils each have a thickness of some tens of $\mu$m.

* * * * *